US009623480B2

(12) United States Patent
Roshan

(10) Patent No.: US 9,623,480 B2
(45) Date of Patent: Apr. 18, 2017

(54) STEEL FOAM AND METHOD FOR MANUFACTURING STEEL FOAM

(71) Applicants: Hathibelagal M. Roshan, Fox Point, WI (US); Maynard Steel Casting Company, Milwaukee, WI (US)

(72) Inventor: Hathibelagal M. Roshan, Fox Point, WI (US)

(73) Assignees: Hathibelagal M. Roshan, Fox Point, WI (US); Maynard Steel Casting Company, Milwaukee, WI (US)

( * ) Notice: Subject to any disclaimer, the term of this patent is extended or adjusted under 35 U.S.C. 154(b) by 0 days.

(21) Appl. No.: 14/576,367

(22) Filed: Dec. 19, 2014

(65) Prior Publication Data

US 2016/0175928 A1 Jun. 23, 2016

(51) Int. Cl.

| | |
|---|---|
| ***B22D 25/00*** | (2006.01) |
| ***B22D 29/00*** | (2006.01) |
| ***B22C 9/10*** | (2006.01) |
| ***B22C 9/22*** | (2006.01) |
| ***B22C 9/02*** | (2006.01) |
| ***B22C 9/24*** | (2006.01) |

(52) U.S. Cl.

CPC ..... *B22D 25/005* (2013.01); *B22C 9/02* (2013.01); *B22C 9/10* (2013.01); *B22C 9/24* (2013.01); *B22D 29/001* (2013.01)

(58) Field of Classification Search

CPC .. B22C 9/10; B22C 9/22; B22D 25/00; B22D 25/005; B22D 29/00; B22D 29/001

USPC ..... 164/132, 134, 137, 369

See application file for complete search history.

(56) References Cited

U.S. PATENT DOCUMENTS

| | | | | |
|---|---|---|---|---|
| 1,403,036 | A | 1/1922 | Kloneck | |
| 2,229,330 | A | 1/1941 | Langhammer et al. | |
| 2,434,775 | A | 1/1948 | Sosnick | |
| 2,751,289 | A | 6/1956 | Elliot | |
| 2,983,597 | A * | 5/1961 | Elliott | C22C 1/08 164/473 |
| 3,126,595 | A * | 3/1964 | Dewey et al. | B22C 9/106 164/23 |
| 3,138,857 | A | 6/1964 | Kuchek | |
| 3,210,166 | A | 10/1965 | Carlson | |

(Continued)

OTHER PUBLICATIONS

Smith et al., "Steel foam for structures: A review of applications, manufacturing and material properties", Journal of Constructional Steel Research, Dec. 9, 2011, 10 pages, Elsevier Ltd.

(Continued)

*Primary Examiner* — Kevin P Kerns

(74) *Attorney, Agent, or Firm* — Michael Best & Friedrich LLP

(57) ABSTRACT

A method of producing a steel foam component includes providing a mold defining a cavity. The method also includes positioning an insert within the cavity of the mold. The insert can be configured to form a generally uniform pattern of pores within the steel foam component, and in some cases occupies at least 20% of the cavity. The method can further include pouring molten steel into the cavity, cooling the molten steel into the steel foam component, and removing the steel foam component and the insert from the mold. Steel components having internal shapes corresponding to the insert(s) are also provided.

18 Claims, 8 Drawing Sheets

(56) References Cited

U.S. PATENT DOCUMENTS

| | | | | |
|---|---|---|---|---|
| 3,264,073 | A | 8/1966 | Schmitt | |
| 3,305,902 | A | 2/1967 | Bjorksten | |
| 3,523,766 | A | 8/1970 | Markus et al. | |
| 4,940,489 | A * | 7/1990 | Cummings | B22D 11/119 266/227 |
| 4,998,578 | A * | 3/1991 | Dwivedi et al. | C04B 35/111 164/6 |
| 5,281,251 | A | 1/1994 | Kenny et al. | |
| 6,203,925 | B1 | 3/2001 | Attard et al. | |
| 6,428,280 | B1 | 8/2002 | Austin et al. | |
| 6,998,535 | B2 | 2/2006 | Nichol | |
| 7,144,636 | B2 | 12/2006 | Dobesberger et al. | |
| 7,461,684 | B2 | 12/2008 | Liu et al. | |
| 7,641,984 | B2 | 1/2010 | Rabiei | |
| 7,682,704 | B2 | 3/2010 | Dwivedi | |
| 8,110,145 | B2 | 2/2012 | Harada | |
| 8,815,408 | B1 | 8/2014 | Cochran et al. | |
| 2007/0296106 | A1 | 12/2007 | Munz et al. | |
| 2010/0190028 | A1 | 7/2010 | Dobesberger et al. | |
| 2014/0091241 | A1 | 4/2014 | Rabiei | |
| 2014/0186652 | A1 | 7/2014 | Poggi | |

OTHER PUBLICATIONS

Smith et al., "Material characterization and microstructural simulation of hollow spheres and PCM steel foams", Annual Stability Conference Structural Research Council, Apr. 18-21, 2012, Grapevine, Texas, 18 pages.

Bekoz et al., "Mechanical properties of low alloy steel foams: Dependency on porosity and pore size", Material Science and Engineering, Vol. A 576, pp. 82-90, Apr. 10, 2013, Elsevier Ltd., Istanbul Turkey, 9 pages.

Raj et al., "Mechanical properties of 17-4PH stainless steel foam panels", Materials Science and Engineering, vol. A 456, pp. 305-316, Nov. 27, 2006, Elsevier Ltd, 12 pages.

Arwade et al., "Reconfiguring Steel Structures: Energy Dissipation and Buckling Mitigation Through the Use of Steel Foams", National Science Foundation, Oct. 5, 2011, 8 pages.

Arwade et al., "Steep foal material processing, properties and potential structural applications", NSF Engineering Research and Innovation Conference, Atlanta, Georgia, 7 pages, 2011.

Srivastava et al., "Processing, stabilization and applications of metallic foams", Art of science, Materials Science—Poland, pp. 734-753, vol. 24 No. 3, 2007, Jamshedpur, India, 22 pages.

Grote, F. et al., "A new foundry engineered process for open-pore metal foam manufacture", Giesserai V. 86, No. 10, pp. 75-78, Oct. 12, 1999.

Razali, Razmi Noh et al., "Mechanical Properties of Aluminium Foam by Conventional Casting Combined with NaCl Space Holder", Applied Mechanics and Materials V. 393, pp. 156-160, 2013.

Lichy, P. et al., "Foundry Processes for Production of Castings with Porous Structure", Hunticke Listy—Metallurgical Journal V. 64, No. 6, p. 109 2011.

Clay et al., "Direct Metal Casting: the ZCast process offers a promising new way to produce aluminum and other nonferrous castings at high speed and low cost" Advanced Materials and Processes V. 161, No. 1, pp. 43-45 Jan. 2003, Z Corporation, Burlington, MA.

Arwade et al., "Steel foam material processing, properties and potential structural applications", NSF Engineering Research and Innovation Conference, Atlanta, Georgia, 2011, 7 pages.

Furman et al., "The development of technology for production casting porous materials with necessary properties" MMT-2002: Second International Conference on Mathematical Modeling and Computer Simulation of Metal Technologies; Ariel; Israel; Sep. 30-Oct. 4, 2002 pp. 2.16-2.22, Sep. 30, 2002 (Abstract).

International Search Report and Written Opinion for Application No. PCT/US2015/66253 dated Mar. 16, 2016 (13 pages).

* cited by examiner

STEEL FOAM AND METHOD FOR MANUFACTURING STEEL FOAM

BACKGROUND

The present invention relates to steel foam and, more particularly, to steel foam and methods of producing steel foam.

Metal is considered a foam if pores are distributed within the metal to take up a certain minimum percentage of the total volume of the metal. The introduction of pores or voids into a metal component typically decreases the density and weight of the metal component compared to a solid metal component. Metal foam components also frequently display a higher plate bending stiffness than solid metal components. Currently, commercial metal foam components are generally limited to aluminum, despite the fact that steel foam components would exhibit many superior properties if they could be produced in volume at reasonable cost.

SUMMARY

Embodiments of the present invention provide the ability to produce steel foam components having consistent densities. In addition, embodiments of the present invention provide the ability to produce steel foam components having predictable mechanical properties. Furthermore, embodiments of the present invention provide the ability to produce steel foam components on an industrial scale.

The present invention provides engineers working with steel a new degree of freedom: density. The design space potentially covered by steel applications can grow significantly with density as a variable. Among other things, the present invention opens new opportunities for designers to find suitable military and naval applications for not only energy absorption, but also blast resistant and ballistic applications to resist the impact of sharp objects due to their high strength and hardness.

Some embodiments of the present invention provide a method of producing a steel foam component, wherein the method comprises providing a mold defining a cavity, positioning an insert within the cavity of the mold, wherein the insert is configured to form a generally uniform pattern of pores within the steel foam component and occupies at least 20 percent of the cavity, pouring molten steel into the cavity, cooling the molten steel into the steel foam component, and removing the steel foam component and the insert from the mold.

In some embodiments, the present invention provides a steel foam component comprising a body having a plurality of pores, the plurality of pores forming a generally uniform pattern throughout the body and occupying at least 20 percent of a volume of the body.

Some embodiments of the present invention provide an insert for use with a mold for creating a steel foam component, wherein the insert comprises a 3D-printed body including a plurality of interconnected cores, the 3D-printed body being configured to be positioned within the mold to form the steel foam component having a desired density that is less than a solid steel component.

Other aspects of the present invention will become apparent by consideration of the detailed description and accompanying drawings.

DETAILED DESCRIPTION

Before embodiments of the present invention are explained in detail, it is to be understood that the invention is not limited in its application to the details of construction and the arrangement of components set forth in the following description or illustrated in the accompanying drawings. The invention is capable of other embodiments and of being practiced or of being carried out in various ways.

Figure 1:
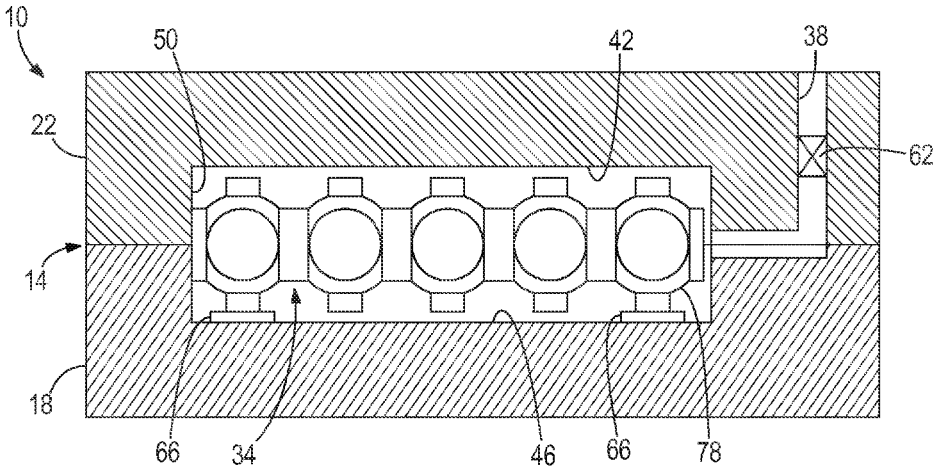
FIG. 1 is a schematic of a system for producing a steel foam component.

FIG. 1 illustrates a system 10 for producing a steel foam component. The illustrated system 10 includes a three dimensional mold 14 formed in two halves, a bottom half 18 (i.e., a drag) and a top half 22 (i.e., a cope). The mold 14 is formed from wood or metal and filled with drag sand. The bottom half 18 and the top half 22 define a cavity 34 within the drag sand of the mold 14. The cavity 34 is formed in the shape of the steel foam component being produced. At least one of the halves 18, 22 also defines a pour opening 38 (e.g., a fan gate) in communication with the cavity 34. The opening 38 allows molten steel to be poured into the cavity 34. The cavity 34 is defined by an upper inner surface 42, a lower inner surface 46, and an inner peripheral surface 50 extending between the upper inner surface 42 and the lower inner surface 46.

Positioned within the pour opening 38 is a filter 62. In some embodiments, the filter 62 may be composed of alumina. In other embodiments, the filter 62 may be composed of other materials suitable for use with molten steel. In the illustrated embodiment, the filter 62 is coupled to the top half 22 of the mold 14. The filter 62 is secured within the pour opening 38 and substantially fills a length of the pour opening 38.

The system 10 also includes at least one chaplet 66 positioned within the cavity 34 of the mold 14. Each chaplet 66 is a relatively thin shim made of metal. The chaplets 66 support an insert 78 above the lower inner surface 46 of the mold so that the insert 78 is spaced apart from (i.e., does not directly contact) the lower surface 46.

Figure 2:
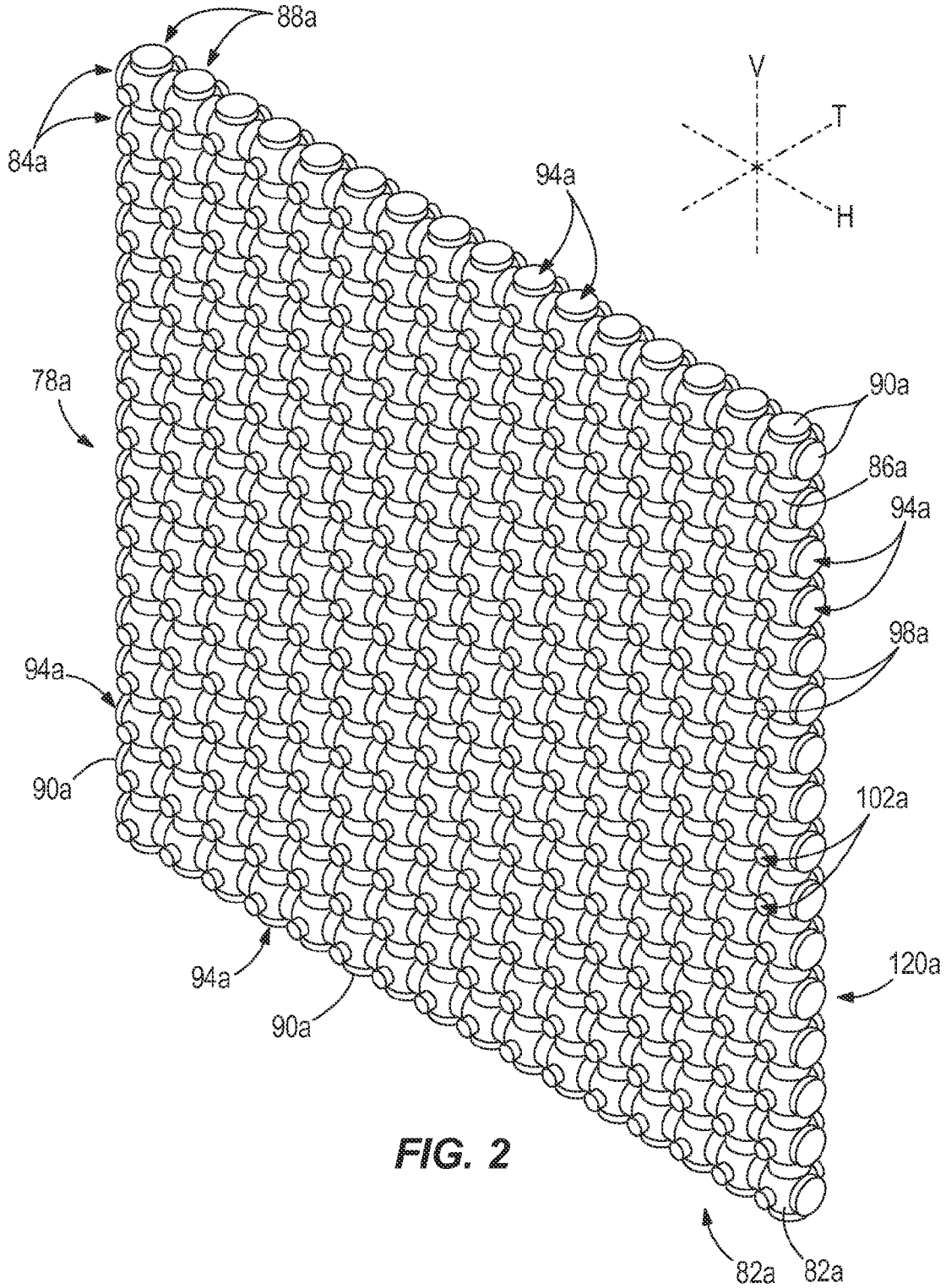
FIG. 2 is a perspective view of an insert for use with the system of FIG. 1.
Figure 3:
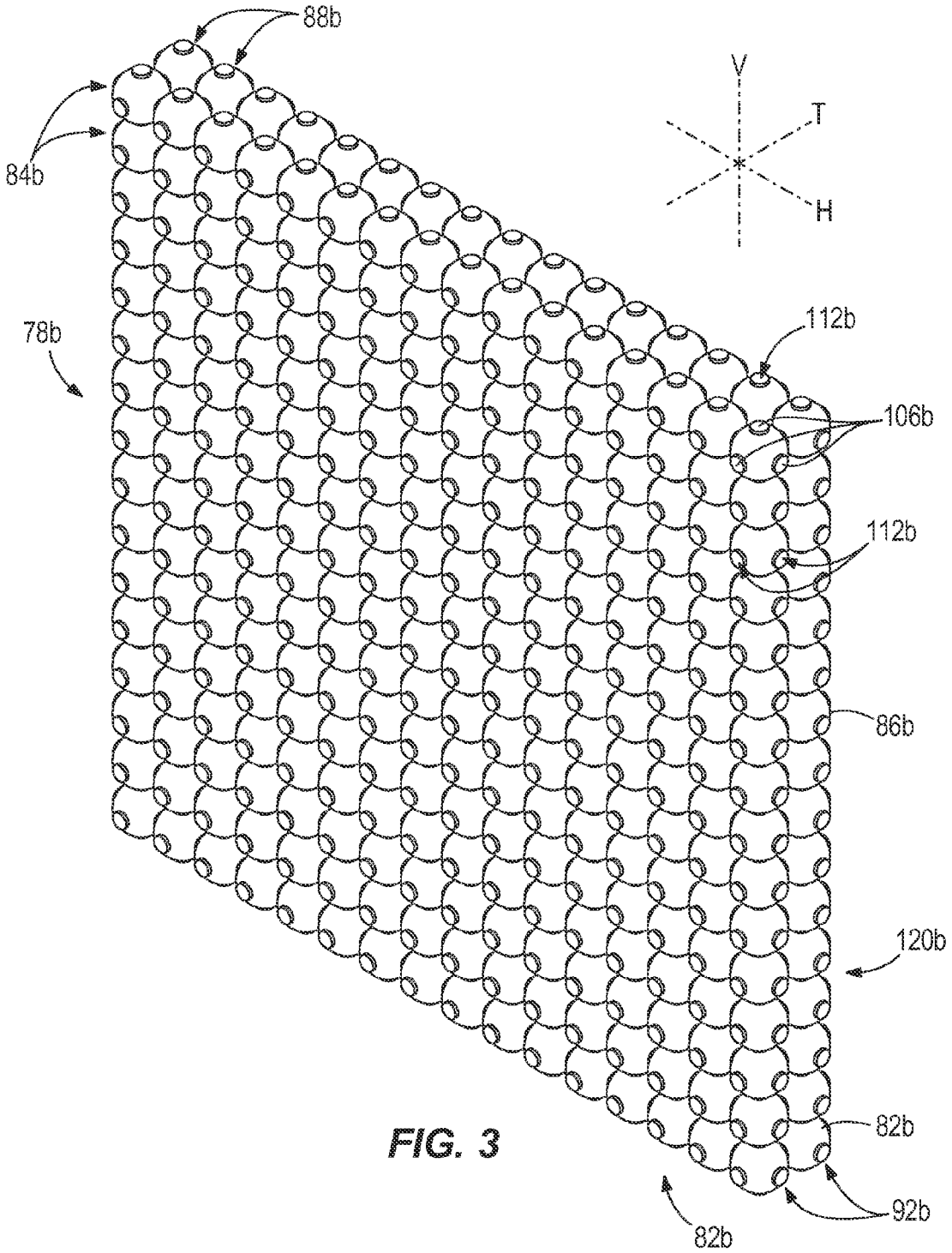
FIG. 3 is a perspective view of another insert for use with the system of FIG. 1.
Figure 4:
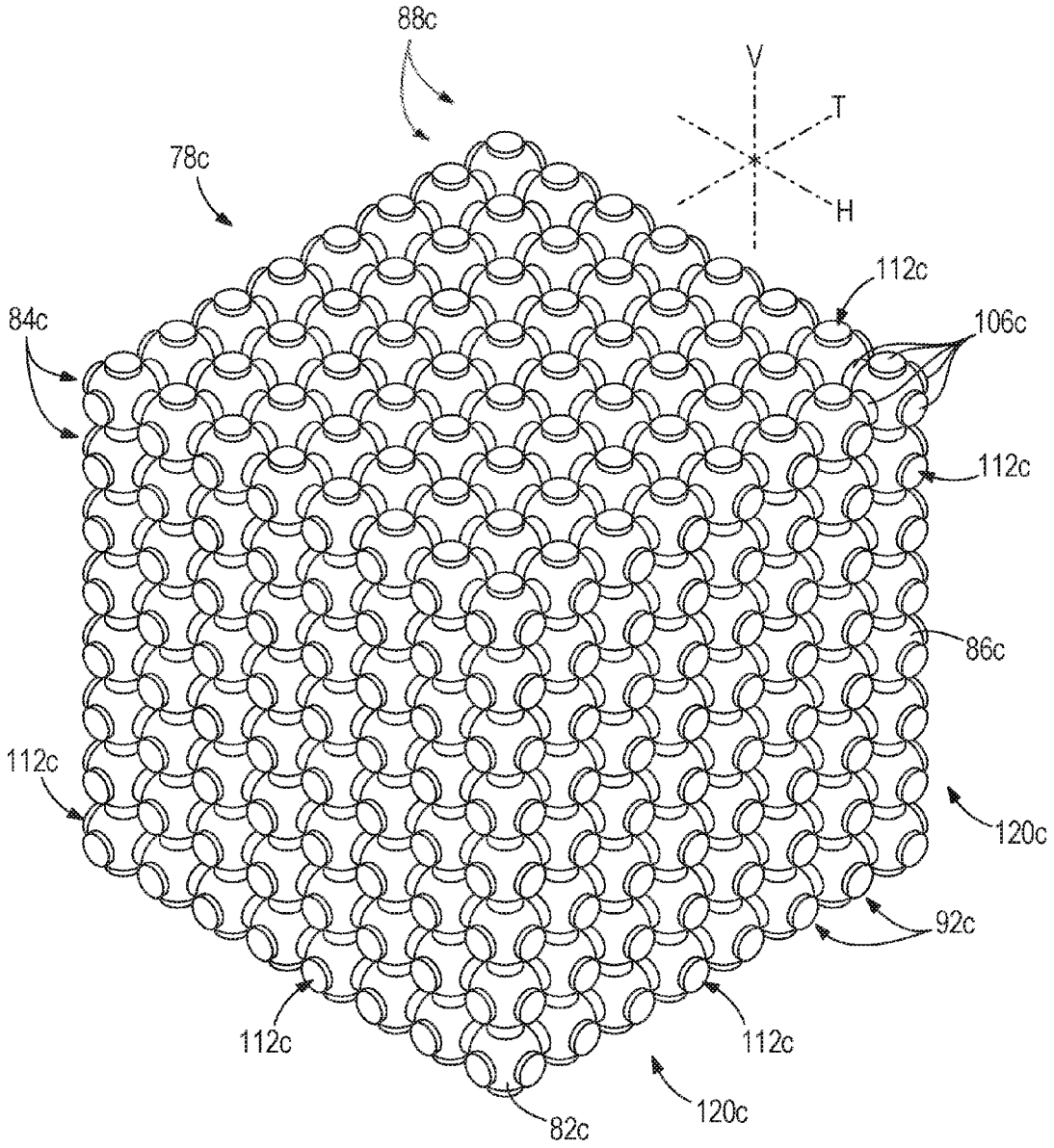
FIG. 4 is a perspective view of yet another insert for use with the system of FIG. 1.

FIGS. 2-4 illustrate embodiments of inserts 78*a-c* for use in the system 10 of FIG. 1. In the illustrated embodiments, the inserts 78*a-c* are 3D-printed inserts (i.e., inserts formed using a 3D printer). In other embodiments, the inserts 78*a-c* may be made using other suitable means. For example, the inserts 78*a-c* could be extruded, blow-molded, form molded, cast, packed, machined, carved, or otherwise formed into a desired shaped. The process used to create the inserts 78*a-c* can be highly-repeatable (like 3D printing or extruding), can be randomized (like blow-molding), or can be a one-off-type process (e.g., hand sculpted).

In addition, the illustrated inserts 78*a-c* are composed of sand bonded with a chemical binder (e.g., resin), but may alternatively be composed of other suitable materials. As used herein, "sand" refers to any flowable material or media, such as small beads, grains, or granules. For example, the sand may be conventional sand, foundry sand, kinetic sand, sand-fiber mixtures, sand-clay mixtures, ceramics, silica alumina, combinations of materials, and the like. The sand is a media that can withstand high temperatures for steel casting, but is held together by a binder that burns off slowly when exposed to the high temperatures.

Although the inserts 78*a-c* are described below with reference to specific embodiments, it should be readily apparent that other shapes and sizes of inserts may also or alternatively be employed. For example, by creating the inserts 78*a-c* with a 3D printer, the geometric configuration of the inserts 78*a-c* may be selected and designed to create any desired pattern of pores within a steel component. Furthermore, the dimensions of the inserts 78*a-c* may be scaled as desired to match the dimensions of any steel component. Multiple inserts may also be positioned within a single mold cavity to achieve desired geometries and sizes.

As shown in FIG. 2, the insert 78*a* includes a plurality of interconnected cores 82*a*. The illustrated cores 82*a* are in the form of repeating geometric shapes. By way of example only, the interconnected cores 82*a* are arranged in rows 84*a* arranged parallel to a horizontal axis H. The repeating interconnected cores 82*a* are further arranged in columns 88*a* that are parallel to a vertical axis V. The horizontal axis H and the vertical axis V are used to facilitate discussion of the inserts 78*a-c* with reference to the figures, and are not intended to be limiting.

Each of the interconnected cores 82*a* includes a central portion 86*a* and protrusions 90*a* extending from the central portion 86*a*. The illustrated central portions 86*a* are spheres. In the illustrated embodiment, four protrusions 90*a* extend from each of the central portions 86*a* in directions parallel to either the horizontal axis H or the vertical axis V. As shown, two of the protrusions 90*a* extend parallel to the horizontal axis H and in opposite directions. Further, two of the protrusions 90*a* extend parallel to the vertical axis V and in opposite directions. The protrusions 90*a* adjacent edges of the insert 78*a* further define ends that are flat surfaces 94*a*. Each core 82*a* additionally includes two secondary protrusions 98*a* extending in opposite directions from the central portions 86*a* along a third axis T. The third axis T is perpendicular to the horizontal axis H and the vertical axis V. The illustrated secondary protrusions 98*a* are generally smaller than the protrusions 90*a*. The protrusions 98*a* further define ends with flat surfaces 102*a*. The insert 78*a* further defines a periphery 120*a*, which includes the endmost rows 84*a* (i.e., highest and lowest along the vertical axis V) and the endmost columns 88*a* (i.e., leftmost and rightmost along the horizontal axis H.).

Although the illustrated central portions 86*a* are spherical, in other embodiments, the central portions 86*a* may be non-spherical. For example, the central portions 86*a* may be square, hexagonal, octagonal, rotund, bulbous, oblong, footballs, and the like. Alternatively, the central portions 86*a* may essentially be omitted such that the protrusions 90*a*, 98*a* are directly connected together as a series of pipes. In some embodiments, the shapes of the central portions 86*a* may vary throughout the insert 78*a*.

The illustrated interconnected cores 82*a* in FIG. 2 are connected together using 3D-printing techniques. For example, the interconnected cores 82*a* along the periphery 120*a* are coupled to two other interconnected cores 82*a* if located at the corners of the insert 78*a*, and are coupled to three other interconnected cores 82*a* if located elsewhere along the periphery 120*a* of the insert 78*a*. In addition, each core 82*a* located within the periphery 120*a* is connected to four other cores 82*a*. In other embodiments, other geometric and non-geometric shapes may be created by interconnecting the cores 82*a* in other manners (e.g., the cores 82*a* can be connected diagonally, in a honeycomb pattern, as a double helix, in a web, etc.).

As shown in FIG. 3, interconnected cores 82*b* of the illustrated insert 78*b* include central portions 86*b* that are substantially spherical. Further, each interconnected core 82*b* includes six similarly-sized protrusions 106*b* extending from the central portions 86*b*. The protrusions 106*b* are oriented such that two of the protrusions 106*b* extend along the vertical axis V in opposite directions, two of the protrusions 106*b* extend along the horizontal axis H in opposite directions, and two of the protrusions 106*b* extend along the third axis T in opposite directions. Each protrusion 106*b* defines a flat end surface 112*b*.

The interconnected cores 82*b* form a plurality of rows 84*b* parallel to the horizontal axis H. The interconnected cores 82*b* also form a plurality of columns 88*b* arranged parallel to the vertical axis V. In the illustrated embodiment, the insert 78*b* includes sixteen rows 84*b* and sixteen columns 88*b* of cores 82*b*. Further, the interconnected cores 82*b* form a plurality of layers 92*b*, each formed of sixteen rows and sixteen columns of interconnected cores 82*b*. The layers 92*b* are arranged along the third axis T, which is perpendicular to the vertical axis V and the horizontal axis H. In the illustrated embodiment, the insert 78*b* includes two layers 92*b* of cores 82*b*, but may alternatively include three or more layers 92*b* of cores 82*b*.

The interconnected cores 82*b* in FIG. 3 are connected together using 3D-printing techniques. For example, the interconnected cores 82*b* along a periphery 120*b* of the insert 78*b* are coupled to three other interconnected cores 82*b* if located at the corners of the insert 78*b*, or four other interconnected cores 82*b* if located elsewhere along a periphery 120*b* of the insert 78*b*. In addition, each core 82*b* located within the periphery 120*b* is connected to five other cores 82*b*. The periphery 120*b* is defined by the endmost rows 84*b* and the endmost columns 88*b* of the insert 78*b*.

As shown in FIG. 4, interconnected cores 82*c* of the insert 78*c* include central portions 86*c* and similarly-sized protrusions 106*c* having flat end surfaces 112*c*, similar to the interconnected cores 82*b* shown in FIG. 3. The insert 78*c* of FIG. 4, however, includes eight rows 84*c* of cores 82*c* that are parallel to the horizontal axis H, and eight columns 88*c* of cores 82*c* that are parallel to the vertical axis V. Further, the interconnected cores 82*c* form eight layers 92*c* of cores 82*c*, each layer 92*c* formed of eight rows and eight columns of interconnected cores 82*c*. The layers 92*c* are arranged along the third axis T, which is perpendicular to the vertical axis V and the horizontal axis H. The illustrated insert 78*c* is, thereby, substantially cube-shaped.

Figure 5:
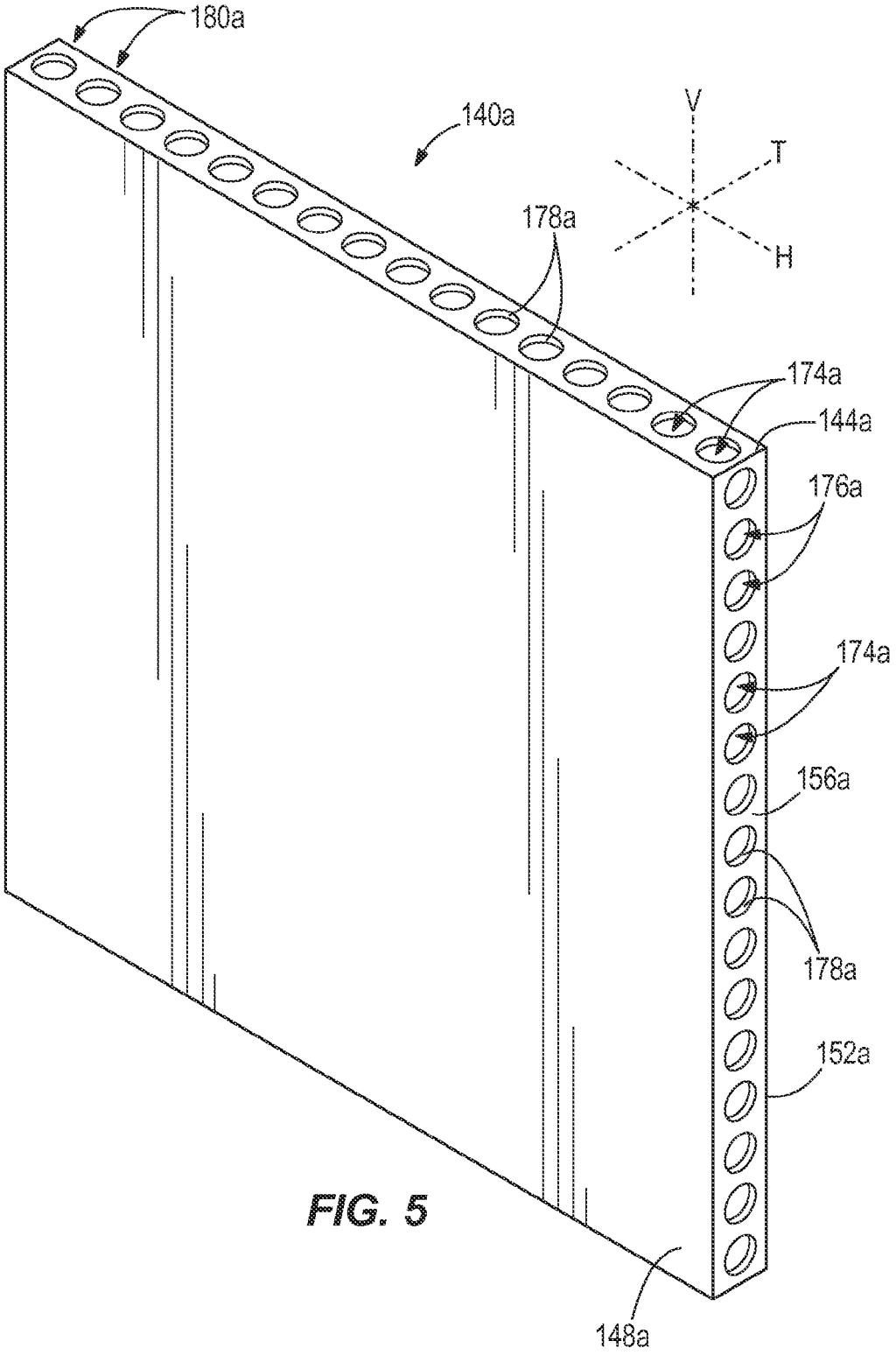
FIG. 5 is a perspective view of a steel foam component produced using the insert of FIG. 3.

FIG. 5 illustrates a steel foam component 140*a* made using the insert 78*a* of FIG. 2 and the system 10 of FIG. 1. The illustrated steel foam component 140*a* has a body 144*a* in the shape of a rectangular prism. The component 140*a* includes a first face 148*a* that is generally square in shape, a second face 152*a* that is generally square in shape and located opposite the first face 148*a*, and a peripheral edge 156*a* extending between the first face 148*a* and the second face 152*a*. As shown, the peripheral edge 156*a* is four-sided. The body 144*a* also includes a plurality of pores 174*a* that can form a generally uniform pattern along the peripheral edge 156*a*. The pores 174*a* are empty voids in the steel foam component 140*a*.

The pores 174*a* in FIG. 5 each have a similar geometric shape. The similar geometric shape generally matches the shape of the interconnected cores 82*a* of the insert 78*a* of FIG. 2. Similar to the arrangement of the plurality of interconnected cores 82*a*, each of the plurality of pores 174*a* is connected to at least one other of the plurality of pores 174*a*. The pores 174*a* are also arranged in a series of pore rows 176*a* and pore columns 180*a*, corresponding to the number of rows 84*a* and columns 88*a* of the insert 78*a*. As shown in FIG. 5, the pore rows 176*a* are parallel to the horizontal axis H. The pore columns 180*a* are parallel to the vertical axis V. Although uniformity of the pores 174*a* has advantages, it will be appreciated that in other embodiments the core size, shape, and/or arrangement can vary across one or more of these directions as desired for the particular application and component characteristics. For example, the core sizes and/or shapes can increase along at least one of the axes H, V, T. The shapes and/or sizes of the pores 174*a* can be varied by changing the shape and/or size of the corresponding insert 78*a*.

As illustrated in FIG. 5, the pores 174*a* communicate through the peripheral edge 156*a* of the steel foam component 140*a*. The openings 178*a* of the plurality of pores 174*a* that communicate through the peripheral edge 156*a* of the steel component are generally the size of the protrusions 90*a* of the insert 78*a* of FIG. 2.

In other embodiments, the plurality of pores 174*a* may not communicate with the peripheral edge 156*a* and/or may communicate with the first and second faces 148*a*, 152*a*. For example, the embodiment shown in FIG. 5 may be modified such that there are openings 178*a* on the first face 148*a* and/or the second face 152*a*. In such embodiments, the openings 178*a* of the plurality of pores 174*a* that communicate through the first and/or second faces 148*a*, 152*a* are generally the size of the small protrusions 98*a* of the insert 78*a* of FIG. 2. As another example, the embodiment shown in FIG. 5 may be modified such that there are no openings on one or more of the faces of the peripheral edge 156*a*, such as by eliminating the protrusions 90*a* on such edges of the insert 78*a* shown in FIG. 2.

Further, the embodiment shown in FIG. 4 may be modified such that there are only openings 178*a* along one side of the peripheral edge 156*a*, or only a portion of the openings 178*a* may be on a side of one or more peripheral edges 156*a*. In any case, at least one pore 174*a* of the plurality of pores 174*a* is configured to communicate through either the peripheral edge 156*a* or the first and/or second faces 148*a*, 152*a* of the steel foam component 140*a*.

Figure 6:
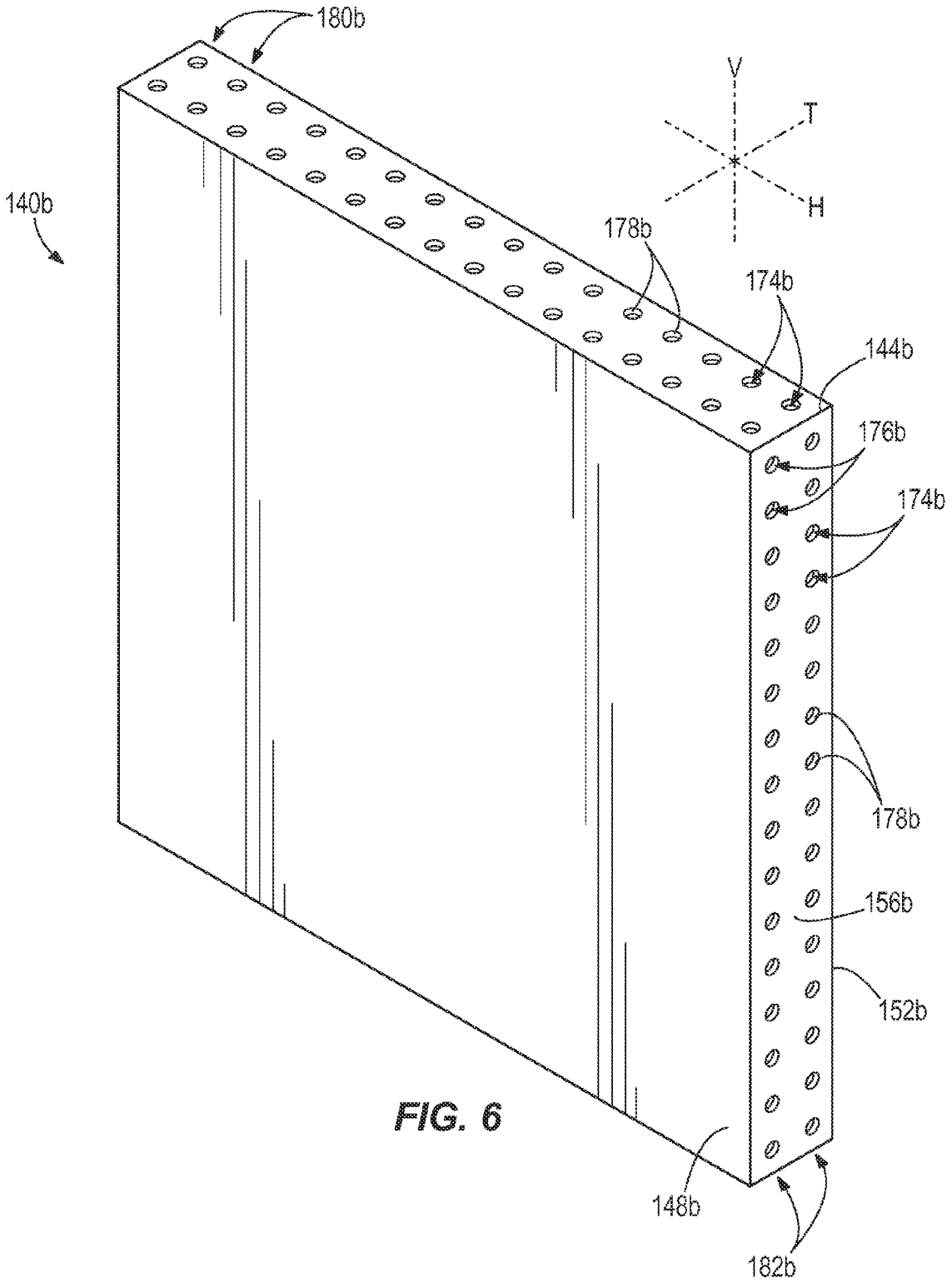
FIG. 6 is a perspective view of a steel foam component produced using the insert of FIG. 4.
Figure 7:
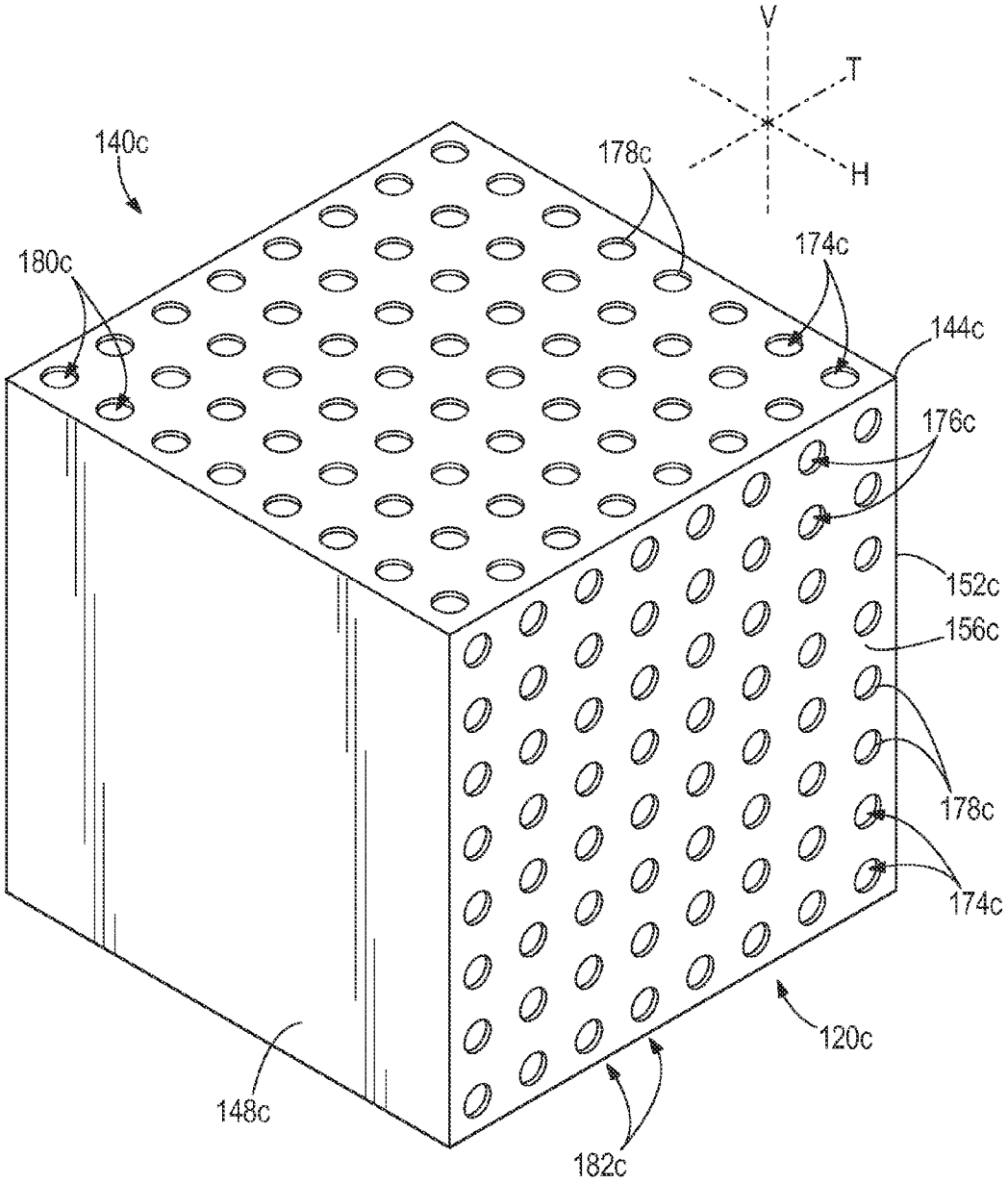
FIG. 7 is a perspective view of a steel foam component produced using the insert of FIG. 5.

FIGS. 6-7 illustrate steel foam components 140*b-c* that are produced using the system 10 of FIG. 1 and the inserts 78*b-c* of FIGS. 3-4, respectively. Similar to the uniform arrangement of interconnected cores 82*b-c* in FIGS. 3-4, respectively, each steel foam component 140*b-c* includes a body 144*b-c* having a plurality of pores 174*b-c* arranged in a uniform manner, with rows 176*b-c* of pores 174*b-c* being arranged parallel to the horizontal axis H and columns 180*b-c* of pores 174*b-c* being arranged parallel to the vertical axis V. The pores 174*b-c* are further arranged in pore layers 182*b-c* along the third axis T. The illustrated embodiments show openings 178*b-c* of the pores 174*b-c* on the peripheries 120*b-c* of the steel foam components 140*b-c*. The openings 178*b-c* may also or alternatively be located elsewhere on the components 140*b-c*. The illustrated openings 178*b-c* are generally the same size as the similarly-sized protrusions 106*b-c* of the inserts 78*b-c*.

As discussed above in reference to FIG. 5, other arrangements of pores 174*b-c* are possible on the peripheral edges 156*b-c* and/or the first and second faces 148*b-c*, 152*b-c* of the embodiments shown in FIGS. 6-7. Further, the pores 174*a-c* in the embodiments shown in FIGS. 5-7 occupy at least 20% of the volumes of the respective bodies. In some embodiments, the pores 174*a-c* occupy between about 20% and about 60% of the volumes of the bodies 144*a-c*. Also, in some embodiments the pores 174*a-c* occupy between about 40% and about 60% of the volumes of the bodies 144*a-c*. In the illustrated embodiment, the pores 174*a-c* occupy approximately 50% of the volumes of the bodies 144*a-c*. In further embodiments, the pores 174*a-c* may occupy more than 60% of the volumes of the bodies 144*a-c*, depending at least in part upon the geometry of the inserts 78*a-c* and the desired structural properties of the steel foam components 140*a-c*.

Figure 8:
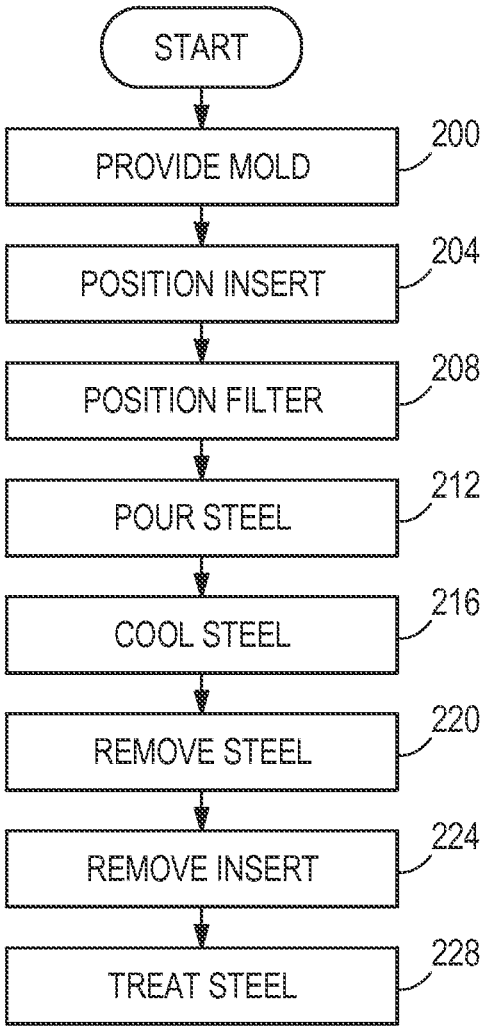
FIG. 8 is a flow chart depicting a method of producing a steel foam component using the system of FIG. 1.

FIG. 8 is a flow chart depicting a method of producing (e.g., casting) a steel foam component 140*a-c*. References below to the steel foam component 140*a-c* generally refer to the steel foam components 140*a*-140*c* from FIGS. 2-4, which are formed using the casting method with the inserts 78*a-c*, respectively, from FIGS. 5-7, although it will be appreciated that the method discussed below is equally applicable to inserts made of any other core shapes, core sizes, and core arrangements as discussed herein.

At Step 200, the mold 14 (FIG. 1) is provided. As discussed above, the mold 14 is made of the bottom half 18 and the top half 22, which together define the cavity 34. The cavity 34 is formed to have the shape and dimensions of the desired component 140*a-c*. Further, the mold 14 defines the pour opening 38. At first, the bottom half 18 and the top half 22 are separated until an insert 78 is positioned within the cavity 34.

Next, at Step 204, the insert 78 is positioned within the bottom half 18 of the mold 14. The insert 78 can be one of the 3D-printed inserts 78*a-c* illustrated in FIGS. 2-4. Alternatively, the insert 78 can be another 3D-printed insert having a different size, shape, and/or geometrical configuration than the inserts 78*a-c* discussed above, and/or can be an insert produced in any of the other manners described herein. After the insert 78 is positioned in the cavity 34, the top half 22 of the mold 14 is coupled to (e.g., positioned on top of) the bottom half 18. The insert 78 fills a desired volume of the cavity 34 with a generally uniform pattern. The volume filled by the insert 78 ultimately forms pores 174*a-c* (i.e., voids) within the steel foam component 140*a-c*, as shown in FIGS. 5-7. As noted above, the insert 78 occupies at least 20% of the volume of the cavity 34. In other embodiments, the insert 78 occupies between about 20% and about 60% of the volume of the cavity 34. In other embodiments, the insert 78 occupies no less than about 60% of the volume of the cavity 34.

In some embodiments, the insert 78 is positioned in the cavity 34 such that the insert 78 is spaced apart from the lower inner surface 46 of the mold 14 and/or from the upper inner surface 42 of the mold 14. The one or more chaplets 66, as shown in FIG. 1, may be used to space the insert 78 from the lower inner surface 46 of the mold 14. Spacing the insert 78 from the upper and/or lower inner surfaces 42, 46 leaves an empty volume in the cavity 34 adjacent the upper and/or lower inner surfaces 42, 46 that may be completely filled with steel. Furthermore, the insert 78 may be positioned within the cavity 34 such that at least a portion of the insert 78 (e.g., the periphery 120*a-c*) abuts the inner peripheral surface 50. Having the insert 78 abut the inner peripheral surface 50 inhibits steel from completely filling the volume adjacent the surface 50.

Positioning the insert 78 so it is spaced from the lower inner surface 46 of the mold 14 provides the steel foam component 140*a-c*, after casting, with a continuous first face (i.e., a solid surface without any openings 178*a-c* within the first face 148*a-c*). Positioning the insert 78 so it is spaced from the upper inner surface 42 of the mold 14 provides the steel foam component 140*a-c*, after casting, with a continuous second face (i.e., a solid surface without any openings 178*a-c* within the second face 152*a-c*). Positioning the insert 78 so that it abuts the inner peripheral surface 50 of the mold 14 creates the openings 178*a-c* in the peripheral edges 156*a-c* of the steel foam component 140*a-c*. In some embodiments, the insert 78 may also or alternatively be spaced apart from the inner peripheral surface 50 of the mold 14 so that one or more of the peripheral edges 156*a-c* of the steel foam component 140*a-c* are continuous.

At Step 208, the alumina filter 62 is positioned within the pour opening 38 of the mold 14. The filter 62 can be positioned within the opening 38 when the mold 14 is first created, or when the mold 14 is assembled after the insert 78 is in position. In some embodiments, this step may be omitted if a filter is not needed.

At Step 212, molten steel is poured into the cavity 34 of the mold 14 through the pour opening 38. As the molten steel is poured into the cavity 34, the molten steel fills the cavity 34 between the insert 78 and the lower inner surface 46, the upper inner surface 42, and the inner peripheral surface 50. The alumina filter 62 (if present) helps control the velocity of the molten steel being poured into the cavity 34, and inhibits the molten steel from deforming or crushing the insert 78 before the steel has cooled.

At Step 216, the molten steel can be cooled using known techniques (e.g., waiting a period of time).

After the steel has cooled, the steel foam component 140*a-c* can then be removed from the mold 14, at Step 220. At this stage, the insert 78, which may be a 3D-printed sand insert 78, has broken down into a powder or other flowable form. The powder still remains within the steel foam component 140*a-c*. As such, the insert 78 is removed from the mold 14 with the steel foam component 140*a-c*.

At Step 224, the powder remains of the insert 78 are decored (i.e., removed) from the steel foam component 140*a-c*. In some embodiments, the powder remains may exit the steel foam component 140*a-c* through the openings 178*a-c* by, for example, shaking the component 140*a-c*. In other embodiments, a new hole may be drilled or cut into the steel foam component 140*a-c* to facilitate removal of the powder from the component 140*a-c*, such as when the steel foam component is provided with no exterior holes through which the powder can exit, or whether an insufficient number of such holes exist. Once the insert 78 is removed from the component 140*a-c*, the plurality of pores 174*a-c* are exposed (i.e., left as empty voids within the steel foam component 140*a-c*). Further, the steel foam component 140*a-c* may be processed to remove excess parts from the steel foam component 140*a-c* that are byproducts of the casting process. For example, the pour opening 38 may have retained cooled steel that remains attached to the desired component. This excess cooled steel can be cut off of the component 140*a-c* using known techniques.

At Step 228, the steel foam component 140*a-c* may be treated to achieve desired physical properties. For example, the component 140*a-c* may be heated treated to a desired hardness (e.g., between 100 BHN and 400 BHN). Additionally, the component may be welded by conventional welding techniques to other steel foam components 140*a-c* to form a desired structure. The steel foam components 140*a-c* are also machinable by common metalworking techniques. The resulting steel foam components 140*a-c* can comprise plain carbon and low alloy steels of matrix strengths varying, for example, from 50 ksi to 150 ksi.

Although the steel foam components shown in FIGS. 5-7 are rectangular prisms, other shapes are possible. For example, steel foam components that are cylindrical, spherical, or that have other geometric and non-geometric shapes are also contemplated. Further, the steel foam components may be formed as combinations of geometric shapes, or may include any combination of geometric and non-geometric shapes. The inserts and molds in such instances would be altered accordingly to create the desired shapes and densities of the steel foam components.

The above techniques allow for the creation of steel foam components with ballistic resistant applications for both military structures (e.g., ballistic plates), civilian structures (e.g., buildings and bridges), naval applications, and the like. The steel foam components also have applications in energy absorption and blast resistance. The steel foam components also have controllable and uniform densities. Steel foam components manufactured according to the processes described herein can be produced relatively inexpensively and on an industrial scale. Compared to aluminum foams, steel foams have higher specific stiffness, higher hardness, and higher strength. Structural advantages of steel foam compared to solid steel include minimization of weight, maximization of flexural strength, increased energy dissipation, and increased mechanical damping. Further applications for steel foam components include, among other things, pistons and propellers. In particular, in a vehicle equipped with a steel foam component for crash protection, the steel foam component decelerates over a longer distance and a longer period of time, thereby limiting changes in speed experienced by vehicle occupants. Further, non-structural benefits of the steel foam components include lower thermal conductivities, improved acoustic performances, allowance of air and fluid transport within the steel foam component, and better electromagnetic and radiation shielding properties.

Although the invention has been described in detail with reference to certain preferred embodiments, variations and modifications exist within the scope and spirit of one or more independent aspects of the invention.

Various features and advantages of the invention are set forth in the following claims.

What is claimed is:

1. A method of producing a steel foam component, the method comprising:

providing a mold, the mold defining a cavity;

positioning an insert within the cavity of the mold, the insert including an array of interconnected cores having predetermined spatial relationships relative to each other, the insert configured to form a generally uniform pattern of pores within at least a portion of the steel foam component and occupying at least 20 percent of the cavity;

pouring molten steel into the cavity;

cooling the molten steel into the steel foam component; and removing the steel foam component and the insert from the mold.

2. The method of claim 1, further comprising removing the insert from the steel foam component.

3. The method of claim 2, wherein removing the insert includes draining the insert out of the steel foam component.

4. The method of claim 1, wherein positioning the insert within the cavity includes positioning a 3D-printed insert within the cavity.

5. The method of claim 4, wherein the 3D-printed insert is composed of sand and a chemical binder.

6. The method of claim 1, wherein the insert occupies between about 20 percent and about 60 percent of the volume of the cavity.

7. The method of claim 1, wherein the mold includes an upper inner surface and a lower inner surface that define the cavity, and wherein positioning the insert within the cavity includes spacing the insert apart from at least one of the upper inner surface and the lower inner surface.

8. The method of claim 7, wherein positioning the insert within the cavity includes spacing the insert apart from both of the upper inner surface and the lower inner surface.

9. The method of claim 8, wherein the mold also includes an inner peripheral surface extending between the upper inner surface and the lower inner surface, and wherein positioning the insert within the cavity includes positioning the insert within the cavity to abut at least a portion of the inner peripheral surface.

10. The method of claim 8, further comprising positioning a chaplet on the lower inner surface of the mold, wherein positioning the insert within the cavity includes positioning the insert on the chaplet to space the insert apart from the lower inner surface.

11. The method of claim 1, wherein providing the mold includes providing the mold with an opening in communication with the cavity, and wherein pouring the molten steel into the cavity includes pouring the molten steel into the cavity through the opening.

12. The method of claim 11, further comprising positioning a filter within the opening, and wherein pouring the molten steel includes pouring the molten steel through the filter.

13. The method of claim 12, wherein positioning the filter includes positioning an alumina filter within the opening.

14. The method of claim 1, wherein the insert is a first insert and the steel foam component is a first steel foam component, and further comprising:

positioning a second insert within a cavity of a mold, the second insert including an array of interconnected cores having the same predetermined spatial relationships relative to each other as the first insert, the second insert configured to form the generally uniform pattern of pores within at least a portion of a second steel foam component and occupying at least 20 percent of the cavity;

pouring molten steel into the cavity;

cooling the molten steel into the second steel foam component; and removing the second steel foam component and the second insert from the mold, the second steel foam component having the same pattern of pores as the first steel foam component.

15. The method of claim 1, wherein each pore of the generally uniform pattern of pores is connected to at least one other pore through a connection of sufficient size to allow powder to flow therethrough, and further comprising draining the insert, as a powder, from the steel foam component.

16. The method of claim 1, further comprising:

breaking down the insert, while in the steel foam component, into a solid flowable form; and draining the solid flowable form out of an opening in the steel foam component.

17. A method of producing a steel foam component, the method comprising:

providing a mold, the mold defining a cavity;

positioning an insert within the cavity of the mold, the insert including an array of interconnected cores having predetermined spatial relationships relative to each other, the insert configured to form a generally uniform pattern of pores within at least a portion of the steel foam component and occupying at least 20 percent of the cavity, each pore of the generally uniform pattern of pores being connected to at least one other pore through a connection of sufficient size to allow solid material flow therethrough;

pouring molten steel into the cavity;

cooling the molten steel into the steel foam component;

removing the steel foam component and the insert from the mold; and draining the insert by solid material flow from the steel foam component.

18. A method of producing a steel foam component, the method comprising:

providing a mold, the mold defining a cavity;

positioning an insert within the cavity of the mold, the insert including an array of interconnected cores having predetermined spatial relationships relative to each other, the insert configured to form a generally uniform pattern of pores within at least a portion of the steel foam component and occupying at least 20 percent of the cavity;

pouring molten steel into the cavity;

cooling the molten steel into the steel foam component;

removing the steel foam component and the insert from the mold;

breaking down the insert while in the steel foam component; and after breaking down the insert, removing the insert as a solid through an opening in the steel foam component.

* * * * *